United States Patent [19]

Barnett et al.

[11] 4,279,685

[45] Jul. 21, 1981

[54] APPARATUS FOR USE IN FILM SPLICING

[75] Inventors: Roger C. Barnett, St. Albans; Robert G. Sharpless, Brentwood; Colin F. Mossman, Hillingdon, all of England

[73] Assignee: The Rank Organisation Limited, London, England

[21] Appl. No.: 128,257

[22] Filed: Mar. 7, 1980

[30] Foreign Application Priority Data

Mar. 7, 1979 [GB] United Kingdom ..... 07989/79

[51] Int. Cl.[3] ..... G03D 15/04

[52] U.S. Cl. ..... 156/509; 156/159; 156/508

[58] Field of Search ..... 156/508, 509, 157, 159, 156/502, 510; 242/58.5

[56] References Cited

U.S. PATENT DOCUMENTS

| | | | |
|---|---|---|---|
| 2,328,447 | 8/1943 | Geyer | 156/509 |
| 2,518,927 | 8/1950 | Ordman et al. | 156/508 |
| 2,677,409 | 5/1954 | Jirouch | 156/509 |
| 2,925,850 | 2/1960 | Kral | 156/509 |
| 3,567,555 | 3/1971 | Stenzenberger et al. | 156/509 |
| 3,616,082 | 10/1971 | Menary | 156/509 |

*Primary Examiner*—Michael G. Wityshyn
*Attorney, Agent, or Firm*—Brisebois & Kruger

[57] ABSTRACT

Apparatus for use in film splicing comprising a carriage (11) supporting a first film strip (16A) and a first film scraper (18), means (13) whereby the carriage is laterally movable transverse to the length of the first film strip, a laterally fixed second film scraper (19) and a laterally fixed support (12) for a second film strip (16B). When the carriage is laterally moved back and forth, the first and second scrapers respectively prepare the ends of the second and first film strips simultaneously.

10 Claims, 3 Drawing Figures

APPARATUS FOR USE IN FILM SPLICING

BACKGROUND TO THE INVENTION

This invention relates to apparatus for use in film splicing.

When two film strips are to be spliced, for example as a result of film breakage, it is necessary to prepare the free ends in order that they may be efficiently joined by use of adhesives, solvents or other suitable bonding agents, hereinafter referred to as adhesive. In particular, it is usually necessary to scrape the film emulsion on one film strip and to remove or roughen the backing on the other film strip so that the adhesive can properly bond the two film strips together. In addition, it is sometimes necessary to trim or cut the ends of the film strips, for example because of irregular shaped ends or incorrect length.

PRIOR ART

Various machines for use in film splicing are known, including machines for performing individual operations in the splicing process and machines for carrying out the complete splicing process automatically. These known differing machines have various disadvantages, some machines being complicated and expensive and others requiring undue care and attention by the operator.

In particular, there is known from U.S. Pat. No. 2,518,927 a film splicer which comprises a fixed table and a carriage longitudinally movable thereon. The table and the carriage carry respective trimming knives whereby, when the carriage is moved, the ends of two film strips, respectively mounted transversely across said table and said carriage, are simultaneously trimmed. Continued movement of the carriage abrades the trimmed end of the table mounted film strip and then applies adhesive thereto. Thereafter, further movement of the carriage causes it to slide down a sloped cam surface, eventually to bring the two trimmed film strip ends into splicing engagement. This arrangement is disadvantageously complex, and abrades only one of the two film strips to be spliced. In addition, being a composite uninterrupted operation from trimming to completed splicing, there is no provision for repeated abrading, even of the one film strip which is so treated, in order to ensure an adequately roughened surface.

It is an object of the present invention to provide simple and efficient apparatus for use in film splicing, said apparatus being primarily intended for scraping the ends of the two film strips, but also being capable of including features providing assistance in carrying out further operations in the splicing process.

BRIEF SUMMARY OF INVENTION

According to the invention, there is provided apparatus for use in film splicing, comprising a carriage having an upper surface for supporting a film strip which has a free end to be spliced to the free end of a second film strip, means for linearly moving the carriage laterally back and forth transverse to the length of the film strip supported on said carriage surface, a table support on which the second film strip can be mounted parallel to the first film strip on said carriage, said support being fixed against lateral movement, a first scraper carried by the movable carriage and a laterally fixed second scraper, the arrangement being such that, in use, transverse movement of the carriage causes the first scraper to scrape the end of the second film strip and the second scraper to scrape the end of the first film strip, while after scraping the carriage can be laterally repositioned within its range of back and forth movement with the scraped film ends in alignment for splicing.

FURTHER FEATURES

Preferably, the carriage supporting surface and the table support carry respective locating means for locating the first and second film strips so that after abrading, machining, or scraping the ends of the film strips, the carriage can be repositioned with the scraped free ends of the film strips positioned in longitudinally overlapping aligned relationship, the table support being constituted by a second carriage which is vertically movable, perpendicularly to its table surface, in order to bring the scraped ends of the first and second film strips into engagement after application of adhesive thereto. Thus, in use of this preferred arrangement, the film strips are located on the respective carriages, and thereby positioned so that the two free ends are in longitudinally overlapping but vertically spaced relationship. The first carriage is then moved laterally back and forth. If desired, the scrapers may be formed with knife edges simultaneously to trim the free ends of the film strips. When the film ends have been prepared, the first carriage is laterally positioned to align the two film strips and adhesive or solvent is applied to the prepared film end; the second carriage is moved vertically to bring the adhesive coated film end into engagement with the other end. Conveniently, the apparatus may include an interlock means for preventing lateral movement of the first carriage when the second carriage is moved into the first and second film strips engaging position.

Preferably, the first and second scrapers are located approximately in alignment in the longitudinal direction, respectively on opposite sides of the respective located film strip positions on the first and second carriages.

The preferred apparatus includes a base supporting a pair of longitudinally-spaced, laterally-extending shafts along which the first carriage is movable and a pair of laterally-spaced, vertically-extending shafts on which the second carriage is movable. While it is possible to mount the second scraper on the second carriage, in the preferred arrangement the second scraper is fixedly mounted on the base, being vertically positioned to pass between the overlapping ends of the first and second film strips during their relative lateral movement in which the said second scraper scrapes the first film strip. It follows from the previous description that, during lateral movement of the first carriage, the second carriage is vertically positioned so that the second film strip is scraped by the first scraper. Locating stops are provided to ensure correct vertical positioning of the second carriage during scraping.

BRIEF DESCRIPTION OF DRAWINGS

A practical arrangement of film splicing apparatus in accordance with the invention will now be described by way of example with reference to the accompanying drawings, in which.

DESCRIPTION OF EMBODIMENT

Figure 2:
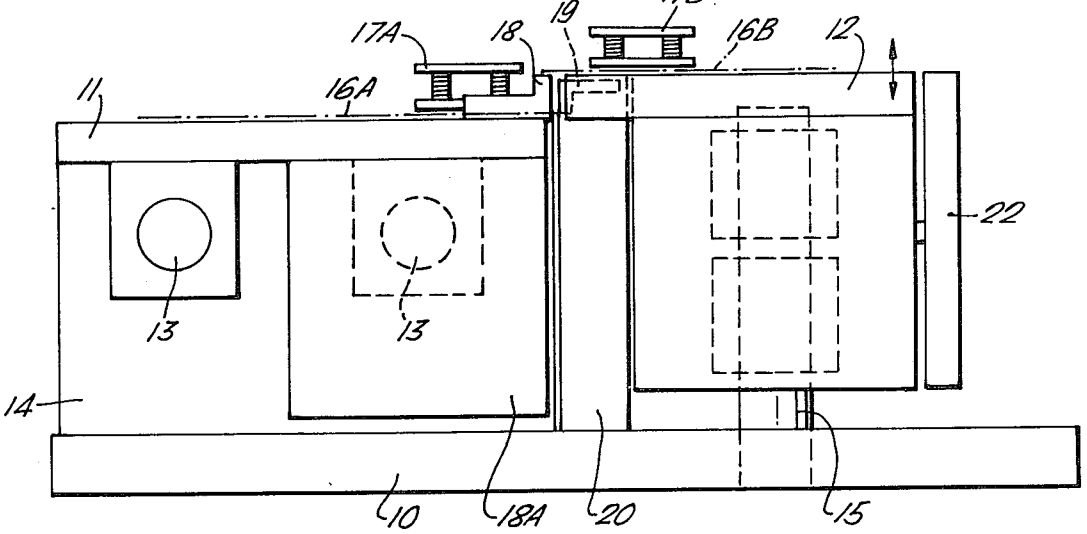
FIG. 2 is a side elevational view of the apparatus in use for preparing the free ends of two film strips.
Figure 3:
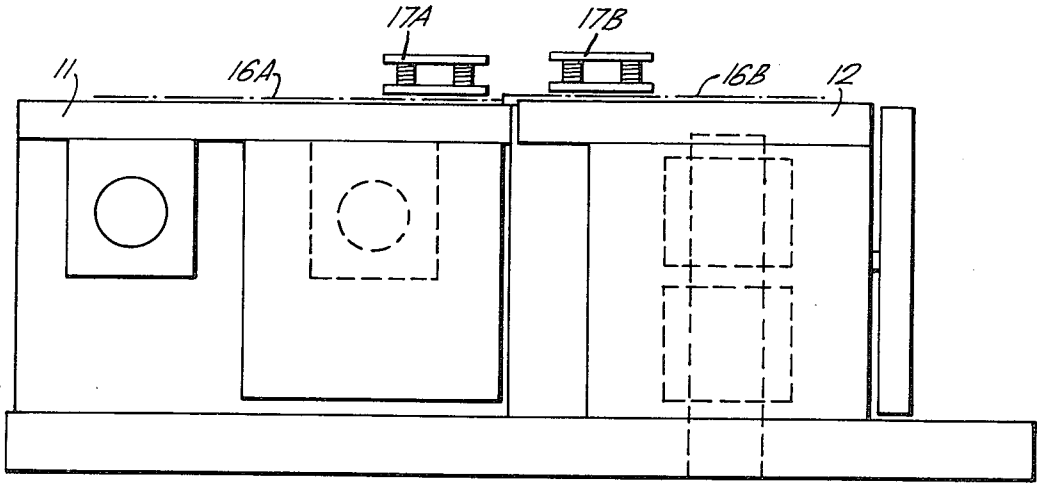
FIG. 3 is a similar elevational view of the apparatus in use to engage the prepared film ends after application of adhesive thereto.

Referring to the drawings, the apparatus comprises a base 10 supporting a first carriage 11 and a second carriage 12. The first carriage 11 is laterally movable by hand along a pair of horizontal shafts 13 carried in parallel relationship by supports 14 on the base 10. In FIGS. 2 and 3, the near support 14 is omitted. The second carriage 12 is vertically movable by hand on a pair of parallel shafts 15 upstanding from the base 10.

The upper surfaces of the first and second carriages serve as tables to support first and second film strips, indicated by dash-dot lines 16A, 16B. Each film supporting surface is provided with a means of locating the sprocket holes in the film (to ensure registration between the two lengths of film) and a film clamp 17A or 17B to firmly hold the film on the film supporting surface. In the longitudinal direction, the free ends of the film strips 16A, 16B are positioned in slightly overlapping relationship at a splicing area between the first and second carriages, where the film supporting surfaces are narrowly spaced in the longitudinal direction.

Figure 1:
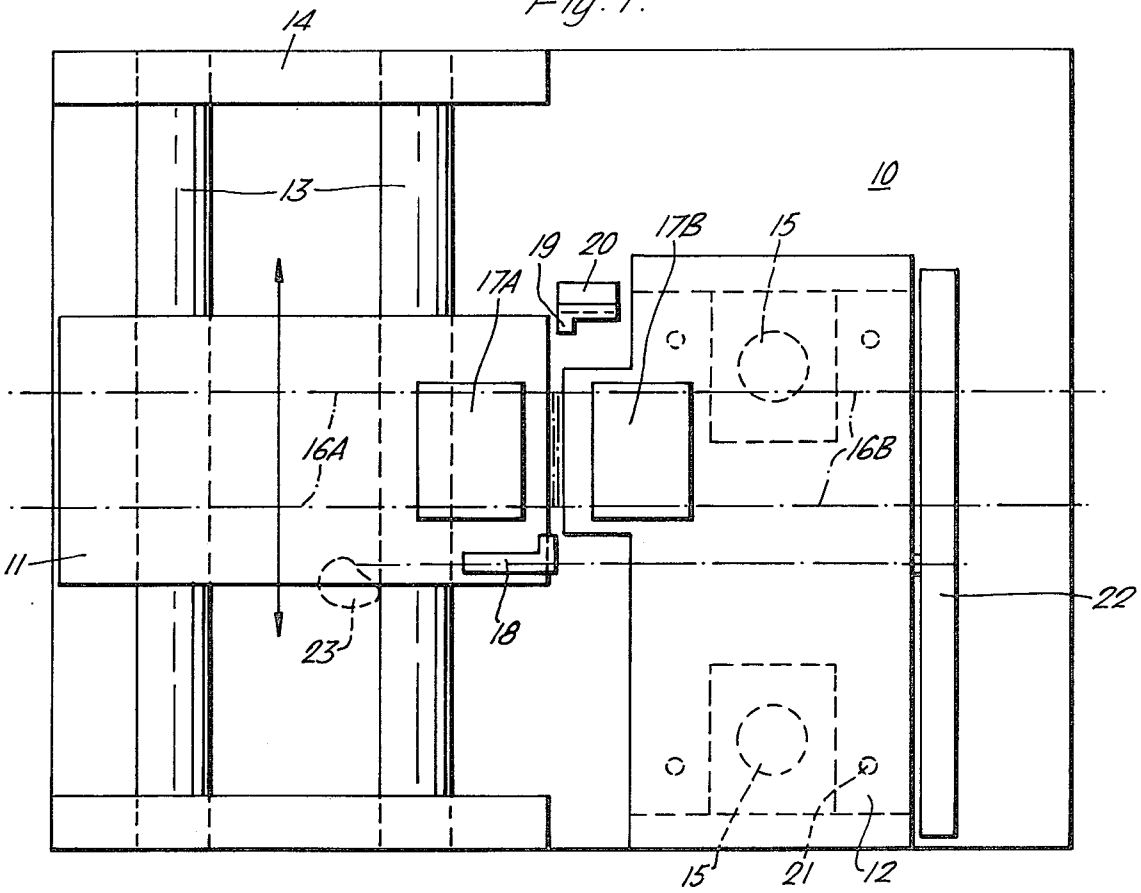
FIG. 1 is a diagrammatic plan view of the apparatus.

The first carriage 11 carries a mounting plate 18A supporting a film scraper 18. A second film scraper 19 is fixedly supported by a bracket 20 on the base. These scrapers 18 and 19, which may also be formed with knife edges for trimming the film ends, are approximately in longitudinal alignment with each other and with the splicing area, but are disposed laterally on opposite sides of the splicing area. In the vertical direction, the second scraper 19 is positioned to scrape the topside of the end of the film strip 16A on the first carriage 11, while the first scraper 18 is positioned to scrape the underside of the end of the film strip 16B when the second carriage 12 is in a raised position, as shown in FIG. 2. The raised position of the carriage 12 is determined by sprung locating stops diagrammatically indicated at 21 in FIG. 1.

In use, film strips 16A, 16B are clamped on the carriages and, with the second carriage 12 raised, the first carriage 11 is moved back and forth in the lateral direction. This causes the first scraper 18 to prepare the end of the film strip 16B and, simultaneously, the second scraper 19 to prepare the end of the film strip 16A. Conveniently, the film strips 16A and 16B are supported emulsion side uppermost, so that the scraper 18 scrapes the film backing of the strip 16B to effect removal of the backing and/or roughening thereof, and the scraper 19 passes between the overlapping film ends to scrape the emulsion on the film strip 16A.

When the film ends have been prepared, adhesive is applied, and then the second carriage 12 is lowered to the position shown in FIG. 3 (in which for clarity the scrapers have been omitted), the carriage 11 having been laterally positioned accurately to align the first and second film strips 16A, 16B. As a result, the ends of the film strips are brought into engagement to complete the splicing process. Conveniently, an interlocking device 22 operating on a cam 23 is provided to lock the first carriage 11 in its correct lateral position when the second carriage 12 is in its lowered film strips engaging position.

It will be appreciated that various modifications of the above-described arrangement are possible within the scope of the invention. For example, the provision for movement of the second carriage is preferred but optional. This carriage may be replaced by a fixed table for supporting the second film strip, the two film strips with prepared ends being removed from the apparatus for application of adhesive and joining. Alternatively, the facility for joining the prepared film strips may be retained in a modified arrangement in which the first carriage is both laterally and vertically movable. It is also possible, by use of a pneumatically or motor-driven shaft driving driving suitable cams, to operate the apparatus on a semi-automatic basis. Such power-driven apparatus may include an adhesive-applying device which is automatically operated at the appropriate intermediate time in the splicing process.

We claim:

1. Apparatus for use in film splicing, comprising a carriage having an upper surface and means for locating thereon a film strip which has a free end to be spliced to the free end of a second film strip, means for linearly moving the carriage laterally back and forth transverse to the length of the film strip supported on said carriage surface, a table support and means thereon by which the second film strip can be located parallel to the first film strip on said carriage, means whereby said support is fixed against lateral movement, a first scraper carried by the movable carriage and a laterally fixed second scraper, the arrangement being such that, in use, transverse movement of the carriage causes the first scraper to scrape the end of the second film strip and the second scraper to scrape the end of the first film strip, while after scraping the carriage can be laterally repositioned within its range of back and forth movement with the scraped film ends in alignment for splicing.

2. Apparatus as claimed in claim 1, in which the scrapers are formed with knife edges for trimming the free ends of the respective film strips.

3. Apparatus according to claim 1, in which the carriage supporting surface and the table support locating means are respectively positioned so that the free ends of the first and second film strips are in longitudinally overlapping aligned relationship, whereby the scraped film ends can be positioned in such relationship after scraping, and the table support is constituted by a second carriage which is vertically movable, perpendicularly to its table surface, in order to bring the scraped ends of the first and second film strips into engagement after application of adhesive thereto.

4. Apparatus according to claim 3, including a base supporting a pair of longitudinally-spaced, laterally-extending shafts along which the first carriage is movable in a first coordinate direction and a pair of laterally-spaced, vertically-extending shafts on which the second carriage is movable in a second coordinate direction.

5. Apparatus according to claim 3, including an interlock means for preventing lateral movement of the first carriage when the second carriage is moved into the first and second film strips engaging position.

6. Apparatus according to claim 3, in which the first and second scrapers are located approximately in alignment in the longitudinal direction, respectively on opposite sides of the respective located film strip positions on the first and second carriages.

7. Apparatus according to claim 6, including a base supporting a pair of longitudinally-spaced, laterally-extending shafts along which the first carriage is movable in a first coordinate direction and a pair of laterally-spaced, vertically-extending shafts on which the second carriage is movable in a second coordinate direction.

8. Apparatus according to claim 7, including an interlock means for preventing lateral movement of the first carriage when the second carriage is moved into the first and second film strips engaging position.

9. Apparatus according to claim 7, in which the second scraper is fixedly mounted on the base, being vertically positioned to pass between the overlapping ends of the first and second film strips during their relative lateral movement in which said second scraper scrapes the first film strip, the second carriage being vertically located during said relative lateral movement so that the second film strip is scraped by the first scraper.

10. Apparatus as claimed in claim 9, including an interlock means for preventing lateral movement of the first carriage when the second carriage is moved into the first and second film strips engaging position.

* * * * *